US005513928A

United States Patent [19]

Eryou

[11] Patent Number: 5,513,928

[45] Date of Patent: May 7, 1996

[54] TRANSFER PAD SYSTEM

[76] Inventor: N. Dennis Eryou, 8 Ivy Pl., Huntington, N.Y. 11743

[21] Appl. No.: 314,075

[22] Filed: Sep. 28, 1994

[51] Int. Cl.[6] ..... E02B 13/00; B09B 1/00

[52] U.S. Cl. ..... 405/52; 405/128

[58] Field of Search ..... 405/52, 38, 15, 405/16, 17, 19, 30, 128, 129

[56] References Cited

U.S. PATENT DOCUMENTS

| | | | |
|---|---|---|---|
| 3,630,762 | 12/1971 | Olton et al. | 405/107 X |
| 4,047,387 | 9/1977 | Tamura et al. | 405/38 |
| 4,190,761 | 2/1980 | Colten | 219/213 |
| 4,194,855 | 3/1980 | Egger | 405/128 |
| 4,712,349 | 12/1987 | Riley et al. | 404/34 |
| 4,950,105 | 8/1990 | Meess et al. | 405/52 X |
| 4,960,345 | 10/1990 | Hurley et al. | 405/38 |
| 4,966,492 | 10/1990 | Poyda | 405/38 X |
| 5,080,528 | 1/1992 | Ressi di Cervio | 405/38 |
| 5,190,406 | 3/1993 | Shannonhouse et al. | 405/129 |
| 5,362,182 | 11/1994 | Hergenröther | 405/38 X |

*Primary Examiner*—Frank S. Tsay
*Attorney, Agent, or Firm*—Daniel R. Schechter

[57] ABSTRACT

A transfer pad in which a central sump is covered with a liquid-impervious membrane. A layer of gravel is then added on top of the membrane. To facilitate monitoring and draining of the pad, a network of perforated pipes is installed within the gravel layer to receive liquids that have filtered through the layer. The gravel layer is then partially covered with concrete, onto which a truck may drive. The layer of gravel may be further covered with a permeable buffer on top of which is added a second layer of gravel. The concrete would then be placed on top of the second layer of gravel. Materials spilled onto the concrete portions of the slab or the gravel are percolated through the gravel layers and collected within the perforated pipes.

12 Claims, 4 Drawing Sheets

TRANSFER PAD SYSTEM

FIELD OF THE INVENTION

This invention relates generally to surfaces for use in the transfer of materials. More specifically, this invention relates to a transfer pad system over which hazardous or other materials are transferred between receptacles or containers.

BACKGROUND OF THE INVENTION

The growing public concern for the environment has lead to a corresponding rise in governmental regulations. One area that has received particular attention, and thus onerous regulations for industry, is the protection of soil and groundwater. Due to the great potential for leaching of substances into the water table and impacting on municipal water supplies, the regulations have become stringent and far-reaching. In some areas, for example, all commercial metal underground storage tanks have had to be replaced with more durable fiberglass tanks equipped with integral leak detection systems.

In the transportation of potentially dangerous substances, such as dry, bulk chemicals, liquid waste and petroleum products, it is imperative to prevent the materials from entering the soil. Once in the soil, it is both difficult and expensive to remove them. For such wet and dry materials, the chief mode of transport is tanker and container trucks. Whenever material is loaded in or unloaded from a container truck, there is always the potential for some material to be spilled. This may be a small amount, such as the residual liquid that may drip when a hose is disconnected. However, given the numerous transfers per day that take place, a significant amount of material may accumulate in the areas of the transfers. In an accident, large amounts of material may be spilled. Without any protection, these materials will end up on the ground, soaking into the soil and eventually into the water table.

To prevent this, regulations in many areas mandate that such truck transfers take place on transfer pads. These pads usually consist of a liquid-impervious concrete base that includes a central sump area and a raised perimeter. The pad is usually larger than the truck so that any material spilling off the truck ends up in the central sump. The material is then kept in the sump until enough has accumulated to be removed and transported to a waste disposal site. Unfortunately, both the removal and disposal are expensive. Since the pads are usually uncovered, any precipitation that falls onto the pad also becomes contaminated by the materials present and must be disposed of at high cost as well. This precipitation problem has been solved with a transfer pad cover, as described in the inventor's U.S. Pat. Nos. 5,197,240 and 5,327,691.

However, there are two other significant problems with conventional transfer pads. First, it is relatively 30 difficult and expensive to create a concrete pad surface that will remain liquid-impervious for an extended period of time. The effects of constant truck traffic, in addition to the effects of inclement weather, especially the deep freezes of the Northern winters, can easily lead to cracking of the concrete. Costly inspection and maintenance programs are then needed to maintain the pads. Second, the purpose of the conventional transfer pad, which is to maintain the dangerous (and ignitable) materials in one contained area also leads to a fire hazard, in that if the accumulated material in the pad's sump is ignited, the truck is essentially sitting in a fire bath. The ignitable material is spread thin and fully exposed to the atmosphere, providing an excellent environment for quick, intense flames.

In view of these deficiencies, it is an object of the invention to provide a transfer pad that is permanently liquid impervious with no maintenance.

It is another object of the invention to provide a transfer pad that minimizes the fire hazards from spilled ignitable materials.

It is yet another object of the invention to provide a transfer pad that is easy and economical to manufacture and maintain.

It is a further object of the invention to provide a transfer pad that is easily monitored and easily drained of any spilled materials.

SUMMARY OF THE INVENTION

According to the objects of the invention, a transfer pad is provided in which a central sump is covered with a liquid-impervious membrane. A layer of gravel is then added on top of the membrane. To facilitate monitoring and draining of the pad, a network of perforated pipes may be installed within the gravel layer to receive liquids that have filtered through the layer. The gravel layer is then partially covered with concrete, onto which a truck may drive. The layer of gravel may be further covered with a permeable buffer on top of which is added a second layer of gravel. The concrete would then be placed on top of the second layer of gravel. Materials spilled onto the concrete portions of the slab or the gravel are percolated through the gravel layers and may be collected within the perforated pipes.

BRIEF DESCRIPTION OF THE DRAWINGS

The afore-mentioned and other objects and advantages will become apparent to those skilled in the art upon reading the following detailed description of the preferred embodiments in conjunction with a review of the appended drawings, in which.

DETAILED DESCRIPTION OF THE PREFERRED EMBODIMENTS

Figure 1:
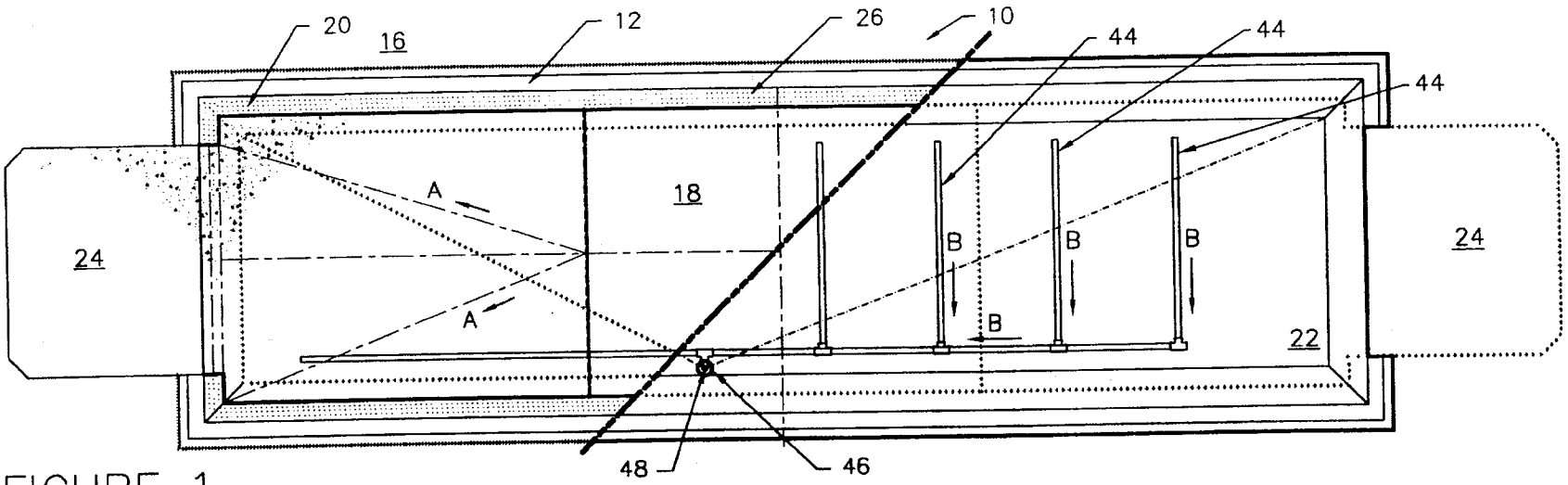
FIG. 1 is a plan view of a transfer pad according to the present invention.
Figure 2:
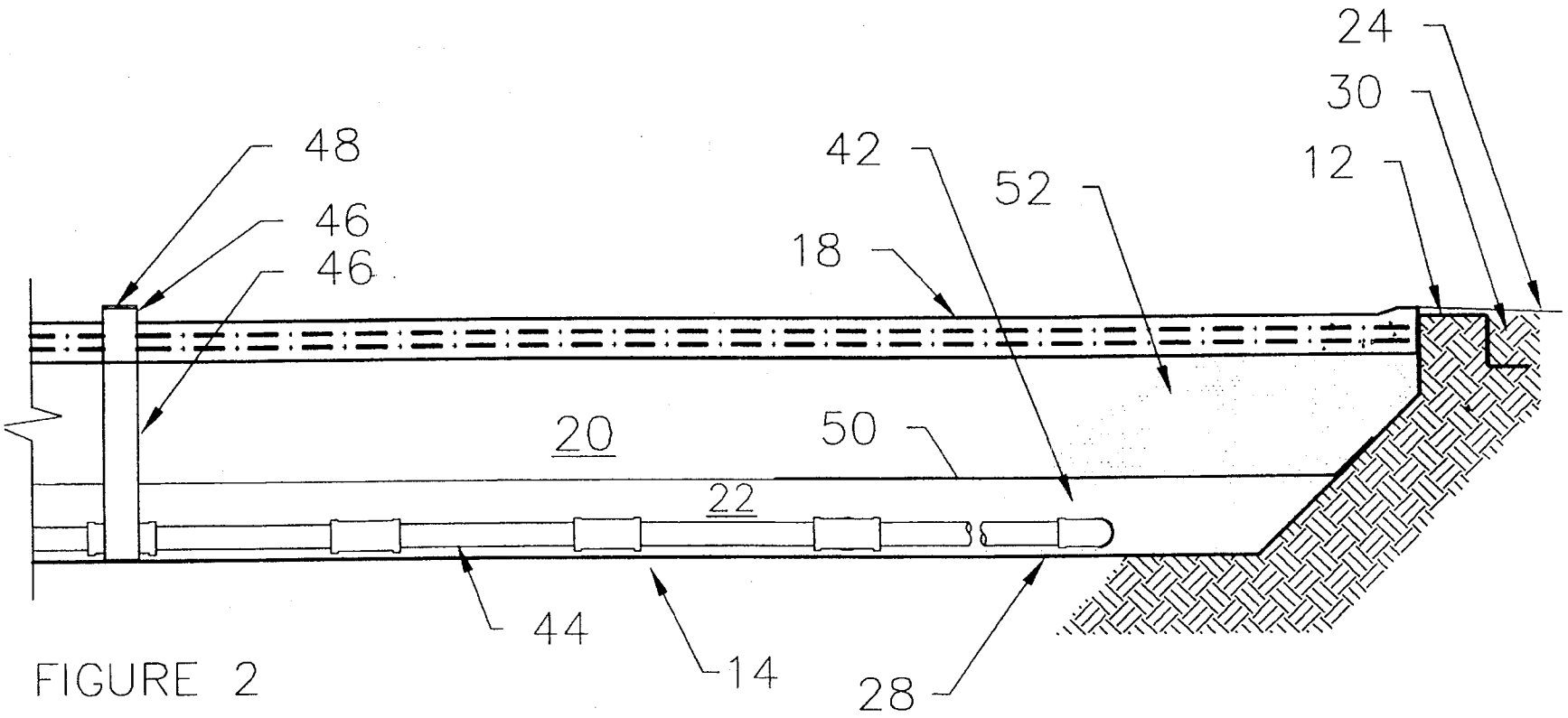
FIG. 2 is a partial side cross-section view of the transfer pad as in FIG. 1.

Referring now to the drawings, a transfer pad 10 according to the preferred embodiment is shown in plan view in FIG. 1 and in side cross-section view in FIG. 2. The pad 10 is comprised of a raised perimeter 12 and a central sump 14, which is generally dug below the surrounding ground level 16. In the preferred embodiment, a concrete slab 18 covers a majority of the central sump 14, which is filled with gravel layers 20,22, as described more fully below. 30 An apron 24, preferably of concrete, extends from either or both ends of the transfer pad 10 and is connected to the concrete slab 18 so that a truck (not shown) may drive up and onto the concrete slab 18. Except where the concrete slab 18 and aprons 24 connect, the slab 18 is surrounded by a gap 26 between the slab 18 and the perimeter 12, where the gravel layer 20 is exposed. The concrete slab 18 is also formed with slightly sloping surfaces (direction of preferred downward slopes shown by arrows A) such that any liquid spilled onto the slab 18 will be guided toward the gravel gap 26. Alternatively, the concrete slab 18 may be replaced with two concrete runners (not shown) approximating the span of a truck's tires. These runners would also be sloped to guide liquids into the surrounding gravel layer 20.

Figure 3:
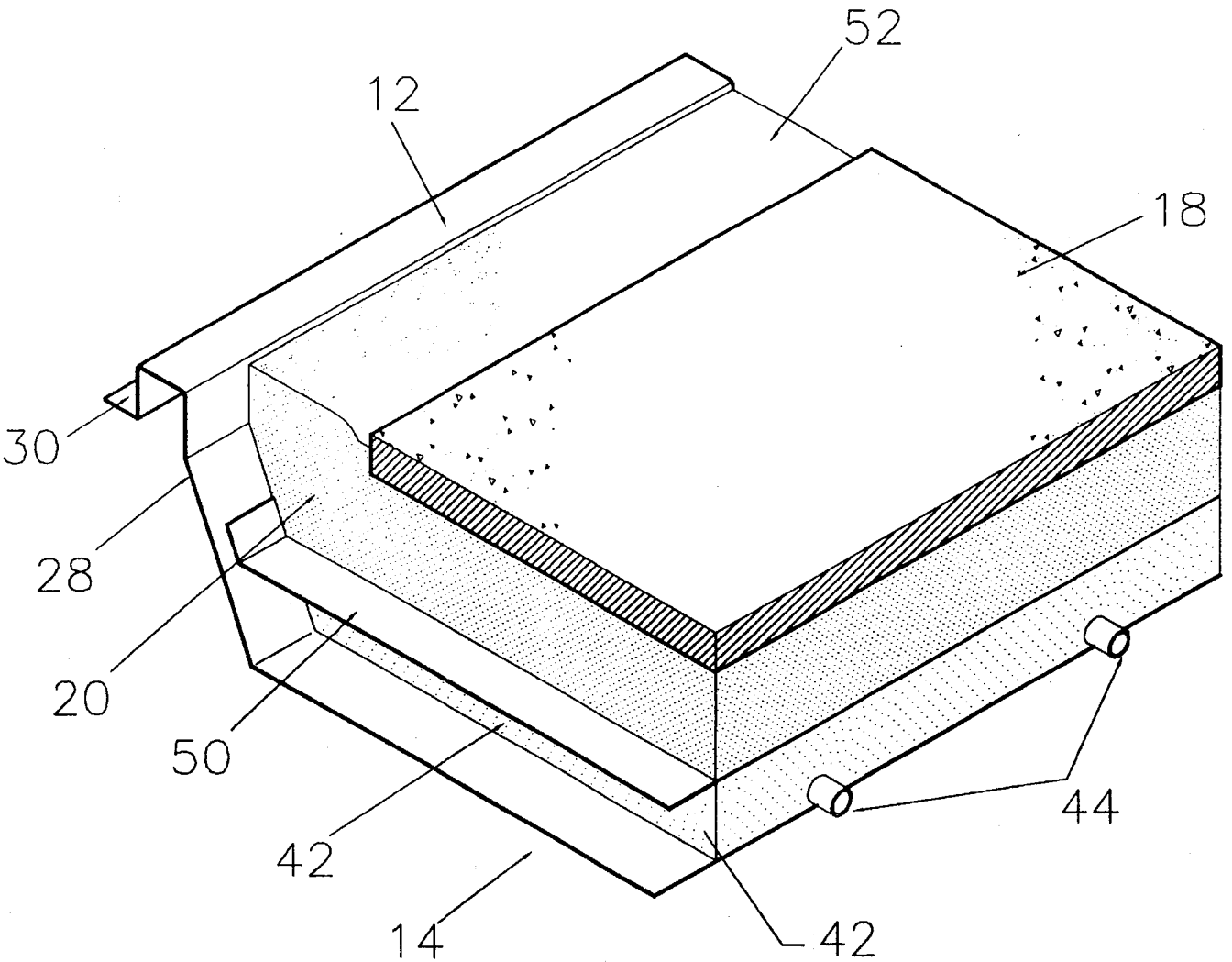
FIG. 3 is a detail perspective cross-section view of the transfer pad.
Figure 4:
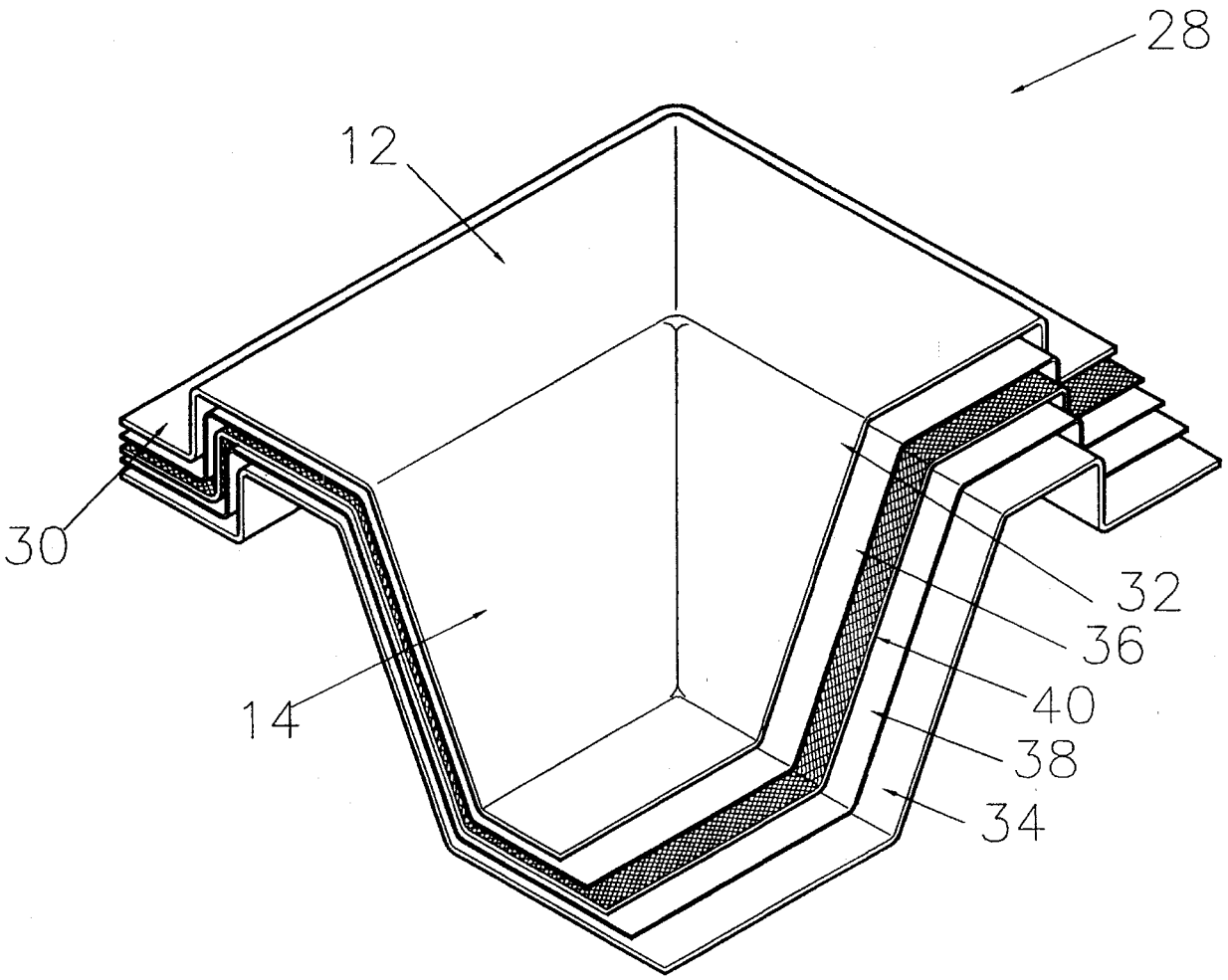
FIG. 4 is an exploded detail view of the bottom membrane of the transfer pad.

As can be seen in FIG. 3, the bottom surface of the entire transfer pad 10 is covered with a geo-membrane 28. The membrane 28 extends beyond the raised perimeter 12 to a surrounding anchor trench 30 where it is anchored by being covered with weight, such as soil (not shown). Any other anchoring mechanism will work similarly. As seen in FIG. 4, the membrane 28 is a complex, multi-layer membrane, and is liquid-impervious. The precise construction of the membrane 28 is unimportant and will often depend on the local regulations, such as those relating to the lining of landfills. Any membrane that remains liquid-impervious over an extended period of time will suffice. In the preferred embodiment, there are at least three layers to the membrane 28, however, depending upon design factors, a single or double layer membrane may be used. The innermost and outermost layers are preferably formed of 8 oz. geotextile. A layer of 80 mil HDPE 36 is then installed next to the innermost layer. If only three layers are used, the 80 mil HDPE layer 36 will also be adjacent to the outermost geotextile layer 34.

Alternatively, if further strength is needed or redundancy in leak tightness is desired, a second layer of 80 mil HDPE 38 may be placed adjacent the outermost layer 34 of geotextile. In between the two HDPE layers 36,38, a layer of 200 mil geonet 40 may be added, to facilitate liquid movement. As can be seen in FIG. 3, the membrane 28 extends over the raised perimeter 12 and into the anchor trench 30 on all sides of the pad, in essence creating a bowl. In this manner, any and all liquid that is spilled on the pad 10 will be contained, ultimately, by the membrane 28. As opposed to conventional concrete pads, which deteriorate over time, the membrane 28 can withstand settling ground, temperature variations and truck traffic without deteriorating, so no inspection or maintenance is required. This is due, at least in part, to the membrane's inherent flexibility and protection from physical contact with the trucks.

Once the membrane 28 is installed, a first layer of gravel 22 is installed at the bottom of the central sump 14. This layer 22 is preferably 9 inches deep, although the thickness of the layer is not critical. This lower layer 22 is made up of relatively fine gravel 42. This finer gravel 42 will prevent the formation of any significant pockets that may retain liquids. Instead, the liquids will freely percolate through this gravel 42 to the bottom of this layer 22.

Interspersed throughout the lower gravel layer 22 is a network of interconnecting pipes 44. These pipes 44 are perforated along their side and top surfaces to allow liquids to flow into the pipes 44 from the surrounding gravel layer 22. The perforations should be small enough to prevent gravel stones 42 from clogging the perforations or entering the pipes 44. In the preferred embodiment, the piping 44 is 3 inch diameter polyvinyl chloride (PVC) pipe, although other sizes and materials will work similarly.

To facilitate monitoring of the level of liquid material and also draining the liquid, the pipe network 44 is constructed to have a gentle slope (direction of downward slopes shown with arrows B), all leading to a well 46. The well 46 is a vertical pipe, preferably 8 inches in diameter, that leads up through the layers of gravel 20,22 and penetrates the concrete slab 18. Usually covered to allow trucks to ride over the well 46, the cover 48 may be removed to allow visual or dipstick monitoring of the liquid level. If necessary, appropriate liquid detectors and warning systems may also be installed within the well. The well 46 also provides a convenient access port for draining collected liquid from the pad 10 through the pipe network 44, such as by using a conventional vac-truck or pump (not shown).

On top of the lower layer of gravel 22 an upper coarse gravel layer 20 is installed, with a geofabric buffer 50 between the two gravel layers 20,22. The geofabric buffer 50 is used to prevent damage to the geo-membrane 28 by sharp stones from the upper gravel layer 20. Another function of the geofabric 50 is to prevent the intermingling of the two gravel layers 20,22, but to allow passage of liquid from the upper gravel layer to the lower layer 22 by gravity.

The upper gravel layer 20 is preferably thicker vertically compared to the lower gravel layer 22, with a thickness of between 2 and 2½ feet, although the exact thickness is not critical. The gravel 52 in this upper layer 20 is also coarser than the gravel 42 of the lower layer 22. When this gravel layer 20 is laid, it is important to pack the layer, such as with the use of a roller or vibrating compactor. If the layer 20 is not packed, the layer 20 will shift and settle when trucks travel over the concrete slab 18, causing the slab 18 to sink and crack. It is also helpful to pack the lower gravel layer 22 before the geofabric buffer 50 is applied, to prevent similar shifting and sinking.

Even when the upper gravel layer 20 is packed, the size of the gravel grains will allow immediate and substantial flow of liquids into the gravel layer 20. In the event of a serious liquid spill, the high porosity of the upper gravel layer 20 will allow the liquid to seep into the gravel 52 without pooling or contaminating the surrounding area 16. To facilitate this absorption, the upper gravel layer 20 is exposed in the gap area 26 partially surrounding the concrete slab. The size of the gap 26 and thus, the amount of the exposed gravel layer 20 is not critical, although it should be sufficient to allow any possible spilled amount to be easily absorbed into the gravel layers 20,22.

The use of gravel 42,52 within the transfer pad 10 also gives a significant advantage over conventional transfer pads when ignitable liquids are spilled. On a conventional pad, spilled liquids collect in the pad and are fully exposed to air. If ignited, only fire-suppression equipment will prevent an immediate pad-engulfing inferno. With the pad 10 of the present invention, however, ignitable or combustible liquids quickly go deep into the pad 10, where the supply of oxygen is extremely limited. In the upper gravel layer 20, any oxygen in the layer 20 would be immediately used up and the fire would likely be self-extinguishing. Once the liquid is below the geofabric buffer 50, combustion is practically impossible. Thus, any fire that might be started would quickly end, without igniting all of the collected liquids in the pad 10. The truck and driver making the transfer would be spared the inferno.

To prevent significant amounts of precipitation from accumulating within the pad 10, which would then become contaminated and would need to be disposed of accordingly, a transfer pad cover may be added. The transfer pad covers shown and described in applicant's U.S. Pat. Nos. 5,197,240 and 5,327,691 may be easily adapted to the pad of the present invention.

To summarize, a truck drives onto the concrete slab 18 from the apron 24 for loading or unloading. If any liquid material is spilled onto the slab 18 (or dry material is washed off with water), the sloping surface of the slab 18 will guide the material to the exposed gap 26 and the upper gravel layer 20. The material will seep into the upper gravel layer 20 and down through the geofabric buffer 50 into the lower gravel layer 22. The material will then travel down to the bottom of the lower gravel layer 22, eventually entering the perforated pipes 44 along the bottom of the transfer pad 10. Within the pipes 44, the material will be conducted toward the monitoring well 46, from which it may be checked and drained. The geo-membrane 28 prevents any material from seeping into the surrounding soil 16.

If collected materials are drained when necessary, the transfer pad 10 will operate without maintenance or monitoring practically indefinitely.

While the embodiments shown and described herein are fully capable of achieving the objects and advantages of the present invention, it is to be understood that these embodiments are shown and described solely for the purpose of illustration and not for the purpose of limitation.

What is claimed is:

1. A transfer pad, said pad comprising:

a central sump, said central sump having a bottom;

a liquid-impervious material covering said sump bottom;

a first layer of gravel within said central sump and on said liquid-impervious material; and a slab mounted on top of said gravel layer.

2. A transfer pad as in claim 1, further comprising:

a second layer of gravel between said first layer of gravel and said slab.

3. A transfer pad as in claim 2, further comprising:

a mesh material positioned between said first and second layers of gravel such that said layers will remain separated.

4. A transfer pad as in claim 2, wherein said gravel of said second layer has larger diameters than the gravel of said first layer.

5. A transfer pad as in claim 1, further comprising:

a perforated pipe positioned within said first layer of gravel.

6. A transfer pad as in claim 5, further comprising:

a well connected to said pipe, said well penetrating said first layer of gravel and said slab.

7. A transfer pad as in claim 6, further comprising:

a network of interconnected perforated pipes positioned with said first gravel layer, said pipes within said network being sloped such that any liquid within said pipes will travel toward said well.

8. A transfer pad as in claim 7, wherein said perforated pipes are perforated along their side and top surfaces.

9. A transfer pad as in claim 6, further comprising a second layer of gravel positioned between said first gravel layer and said slab, said well also penetrating said second gravel layer.

10. A transfer pad as in claim 1, wherein said slab has a first perimeter and said sump has a second perimeter, said slab being dimensioned such that there is a gap between said first and second perimeters.

11. A transfer pad as in claim 10, wherein said gap extends around a majority of said first perimeter, said first gravel layer being exposed to the atmosphere at said gap.

12. A transfer pad as in claim 11, wherein said slab has a sloped surface.

* * * * *